US007195491B1

(12) United States Patent
Chen

(10) Patent No.: US 7,195,491 B1
(45) Date of Patent: Mar. 27, 2007

(54) WRITING BOARD STRUCTURE

(76) Inventor: Ching-Fei Chen, No. 43. Alley 19, Lane 189, Chang Ma Rd., Chang Hua City (TW)

( * ) Notice: Subject to any disclaimer, the term of this patent is extended or adjusted under 35 U.S.C. 154(b) by 0 days.

(21) Appl. No.: 10/388,805

(22) Filed: Mar. 17, 2003

(51) Int. Cl.
*B43L 1/00* (2006.01)

(52) U.S. Cl. ..... 434/408

(58) Field of Classification Search ..... 434/408, 434/413, 414, 416, 421, 422, 425
See application file for complete search history.

(56) References Cited

U.S. PATENT DOCUMENTS 144,212 A * 11/1873 Lyon ..... 434/414
266,118 A * 10/1882 Elsey ..... 434/408
323,350 A * 7/1885 McKenzie ..... 434/413
2,264,244 A * 11/1941 Lytle ..... 434/425
2,303,120 A * 11/1942 Greaves-Walker ..... 524/8
3,846,011 A * 11/1974 Stein ..... 359/460
4,123,590 A * 10/1978 Hasegawa et al. ..... 428/450
4,797,106 A * 1/1989 Umehara et al. ..... 434/408
4,940,628 A * 7/1990 Lin et al. ..... 428/207
5,176,522 A * 1/1993 Robertson, Jr. ..... 434/415
5,716,217 A * 2/1998 Imagawa et al. ..... 434/408
6,506,058 B1 * 1/2003 Frances ..... 434/408

* cited by examiner

*Primary Examiner*—Kurt Fernstrom
(74) *Attorney, Agent, or Firm*—Alan D. Kamrath; Nikolai & Mersereau, P.A.

(57) ABSTRACT

A writing board structure includes a frame, a writing tablet of glass, and a background piece corresponding in size and shape to the writing tablet. The writing tablet and the background piece are held together in the frame such that a rear surface of the writing tablet comes in contact with a front surface of the background piece. The front surface of the background piece is provided with a white coating which is intended to furnish a front surface of the writing tablet with a white background. The front surface of the writing tablet is used for writing or drawing erasably with a pen, chalk, or the like.

4 Claims, 4 Drawing Sheets

WRITING BOARD STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a writing accessory, and more particularly to a writing board similar in nature and purpose to the blackboard.

BACKGROUND OF THE INVENTION

The conventional writing board structure comprises a metal tablet having a predetermined size and an oily white surface for writing on with a pen, chalk, or the like. The marks of the pen or chalk can be easily removed from the oily white surface of the metal tablet by an eraser.

Such conventional writing board as described above is defective in design because the oily white surface of the metal tablet is susceptible to abrasion, or damage which is caused by an eraser containing a volatile solvent, such as toluene.

BRIEF SUMMARY OF THE INVENTION

The primary objective of the present invention is to provide a novel writing board which is free of the deficiencies of the conventional writing board described above.

In keeping with the principle of the present invention, the foregoing objective of the present invention is attained by a writing board structure comprising a frame, a writing tablet of glass, and a white background piece of metal. The writing tablet has a front surface for writing or drawing on with a pen, chalk, or the like. The writing tablet has a rear surface. The background piece has a front surface which is provided with a white coating. The writing tablet and the background piece are corresponding in size and shape and are held by the frame in such a manner that the background piece is disposed behind the writing tablet, and that the rear surface of the writing tablet comes in contact with the front surface of the background piece. The background piece is used to provide the writing tablet with a white background. In light of the writing tablet being made of glass, the writing tablet of the present invention is resistant to abrasion, or damage which may be caused by an eraser containing a volatile solvent.

The present invention may be fastened to the wall surface of a class room, conference room, or the like. In addition, the present invention may be supported on a floor surface by a supporting structure. Moreover, the present invention may be designed to be used on a desk, or the lap of a person.

The features and the advantages of the present invention will be more readily understood upon a thoughtful deliberation of the following detailed description of the present invention with reference to the accompanying drawings.

DETAILED DESCRIPTION OF THE INVENTION

Figure 1:
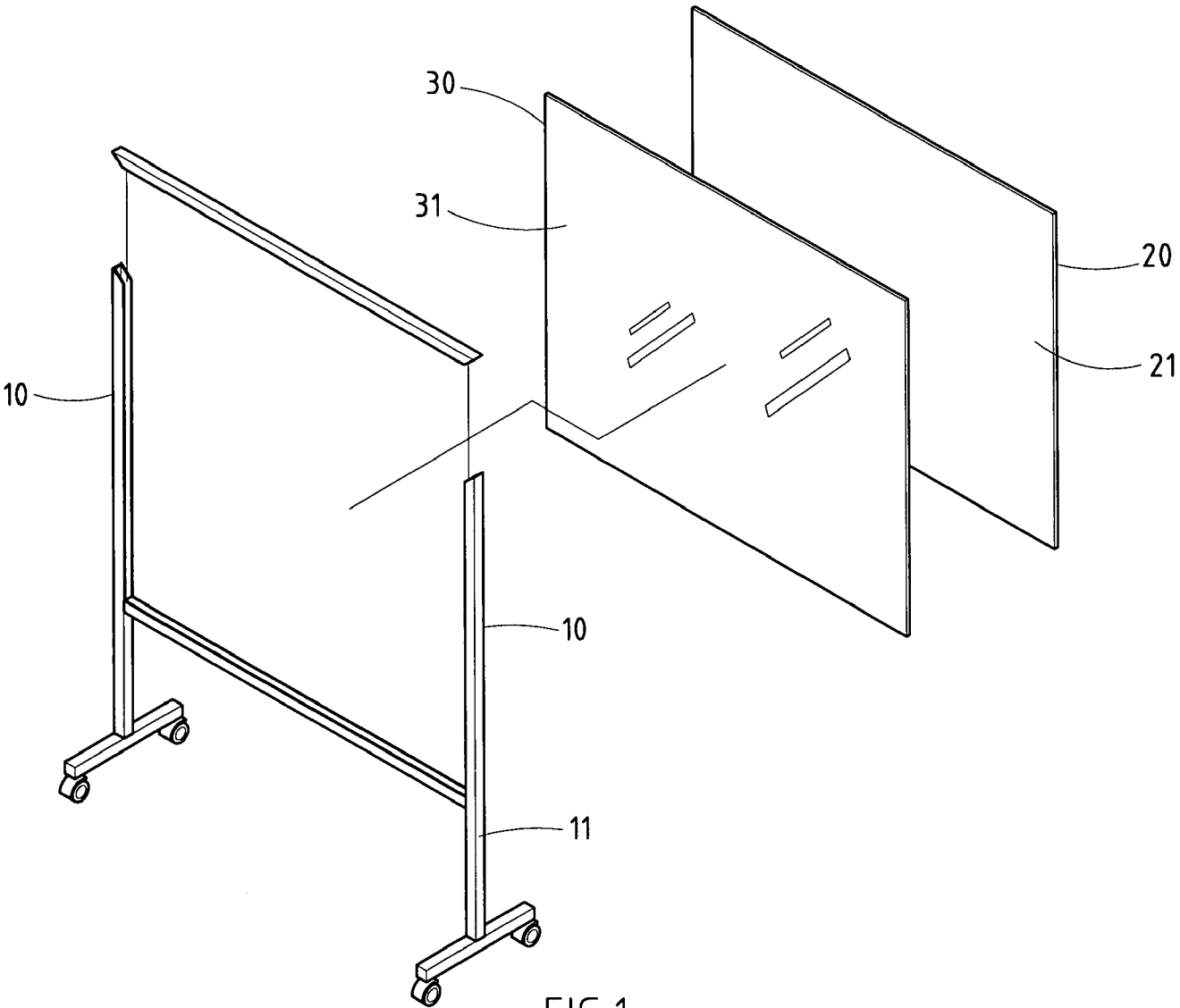
FIG. 1 shows an exploded perspective view of the present invention.
Figure 2:
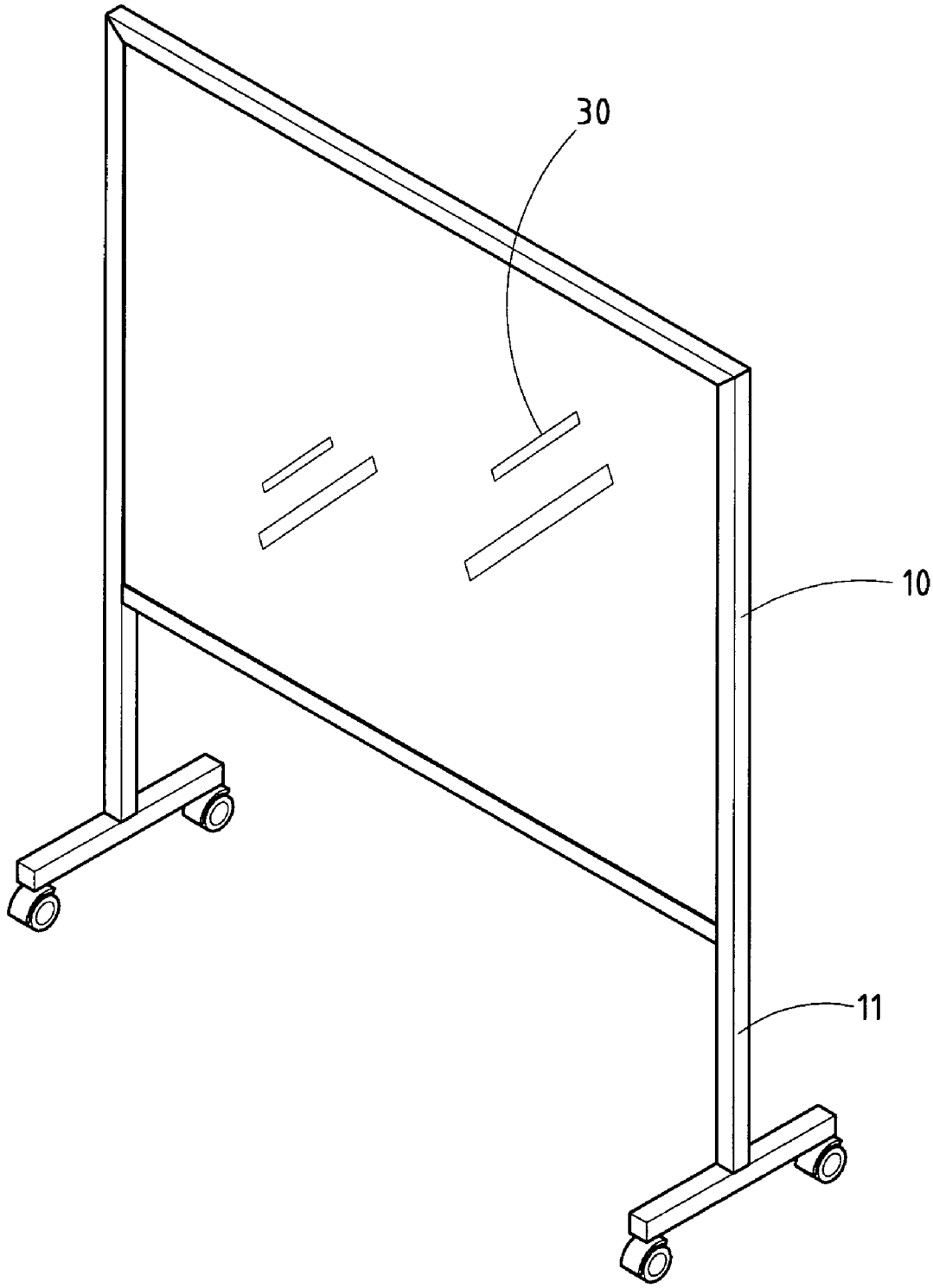
FIG. 2 shows a perspective view of the present invention.
Figure 3:
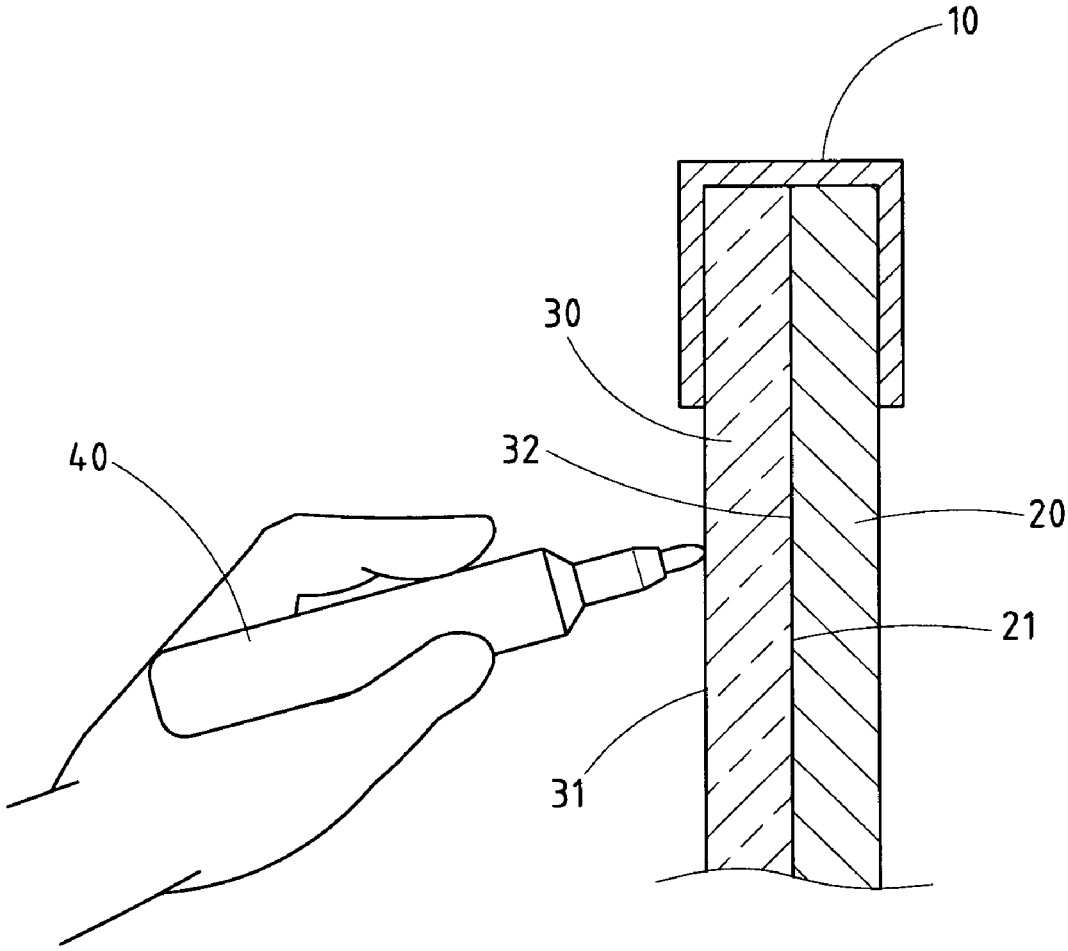
FIG. 3 shows a partial sectional view of the frame, the writing tablet, and the background piece of the present invention.

As shown in FIGS. 1 and 2, a writing board structure of the present invention comprises a frame 10, a background piece 20, and a writing tablet 30. The background piece 20 and the writing tablet 30 are corresponding in size and shape. The background piece 20 is made of metal and has a front surface 21 which is provided with a white coating (not shown in the drawings). The writing tablet 30 is made of glass and has a front surface 31 and a rear surface 32, as shown in FIG. 3. The background piece 20 and the writing tablet 30 are held together by the frame 10 such that the background piece 20 is disposed behind the writing tablet 30, and that the front surface 21 of the background piece 20 comes in contact with the rear surface 32 of the writing tablet 30, as shown in FIG. 3. The white coating of the front surface 21 of the background piece 20 is used to provide the writing tablet 30 with a white background. The front surface 31 of the writing tablet 30 is used for writing or drawing with a pen 40 or the like, as illustrated in FIG. 3. The marks of the pen 40 can be removed from the front surface 31 of the writing tablet 30 by an eraser.

As shown in FIGS. 1 and 2, the frame 10 of the present invention is provided with a base 1 by means of which the frame 10 is supported on a floor surface.

Figure 4:
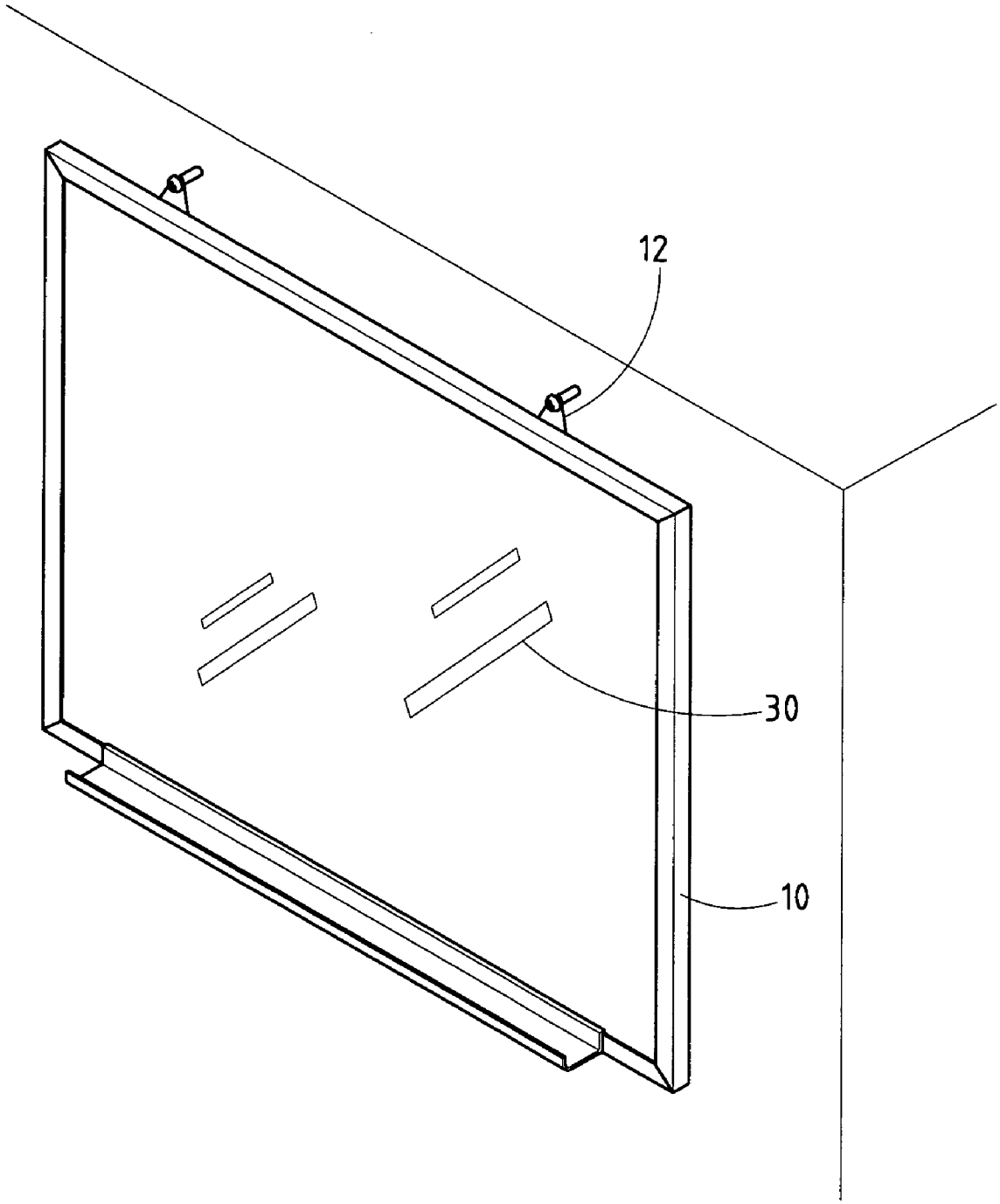
FIG. 4 shows a schematic view of the present invention being fastened to a wall surface.

As shown in FIG. 4, the frame 10 of the present invention is provided with one or more fastening devices 12 by means of which the frame 10 is fastened to a wall surface.

The present invention may be designed to be used on a desk, or on the lap of a person.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A writing board structure comprising:

a frame;

a writing tablet formed of glass and retained in said frame, said writing tablet having a front surface and a rear surface, said front surface suitable for writing or drawing thereon with a pen or with chalk; and a background piece corresponding in size and shape to said writing tablet, said background piece having an unlined front surface having an entirely white coating thereover, said background retained in said frame such that said front surface of said background piece non-adhesively contacts said rear surface of said writing tablet.

2. The writing board structure of claim 1 wherein said background piece is formed entirely of a metal material.

3. The writing board structure claim 1 wherein said frame has a base extending therefrom.

4. The writing board structure of claim 1 wherein said frame has at least one fastening means for fastening said frame to a wall surface.

* * * * *